US006793456B2

(12) United States Patent
Kotani et al.

(10) Patent No.: US 6,793,456 B2
(45) Date of Patent: Sep. 21, 2004

(54) TURBO-COMPRESSOR AND CAPACITY CONTROL METHOD THEREOF

(75) Inventors: Koji Kotani, Tsuchiura (JP); Kazuo Takeda, Chiyoda (JP)

(73) Assignees: Hitachi, Ltd., Tokyo (JP); Hitachi Industries Co., Ltd., Tokyo (JP)

( * ) Notice: Subject to any disclaimer, the term of this patent is extended or adjusted under 35 U.S.C. 154(b) by 32 days.

(21) Appl. No.: 10/247,563

(22) Filed: Sep. 20, 2002

(65) Prior Publication Data

US 2003/0219335 A1 Nov. 27, 2003

(30) Foreign Application Priority Data

May 22, 2002 (JP) ..... 2002-147068

(51) Int. Cl.[7] ..... F04D 27/02

(52) U.S. Cl. ..... 415/1; 415/26; 415/28; 415/48

(58) Field of Search ..... 415/1, 27, 26, 415/28, 144, 118, 160, 914, 17, 48, 49, 50

(56) References Cited

U.S. PATENT DOCUMENTS

| | | | | |
|---|---|---|---|---|
| 3,744,925 A | | 7/1973 | Kraemer | 701/100 |
| 4,464,720 A | | 8/1984 | Agarwal | 415/17 |
| 4,586,870 A | | 5/1986 | Hohlweg | 415/29 |
| 4,770,602 A | | 9/1988 | Miura | 415/1 |
| 4,789,298 A | | 12/1988 | Blotenberg | 415/27 |
| 5,915,917 A | * | 6/1999 | Eveker et al. | 415/1 |

FOREIGN PATENT DOCUMENTS

| | | |
|---|---|---|
| GB | 2316714 | 3/1998 |
| JP | 1-167498 A | 7/1989 |
| JP | 4-136498 A | 5/1992 |

* cited by examiner

*Primary Examiner*—Edward K. Look
*Assistant Examiner*—Dwayne J. White
(74) *Attorney, Agent, or Firm*—Antonelli, Terry, Stout & Kraus, LLP

(57) ABSTRACT

A turbo-compressor comprises a compressor main body for compressing an operation fluid, an inlet guide vane apparatus being provided on a suction side of the compressor main body and having guide vanes, and a blow-off valve being provided in a discharge said compressor main body. An opening of the blow-off valve is variable. A pressure detector is provided on the discharge side of the compressor. At least any one of a time-period and a number of times of operations of the inlet guide vane apparatus is memorized in a memory, when it is operated at an inlet guide vane opening, being equal or less than a setting limit. A controller controls the blow-off valve and the guide vanes based on the values which are memorized in the memory.

10 Claims, 5 Drawing Sheets

TURBO-COMPRESSOR AND CAPACITY CONTROL METHOD THEREOF

BACKGROUND OF THE INVENTION

The present invention relates to a turbo-compressor and a method for controlling a capacity thereof, and in particular, relates to a turbo-compressor being controllable on the capacity with using variable inlet guide vanes and the capacity control method thereof.

With the turbo-compressor relating to the conventional art, for the purpose of protecting it from surging occurring in a region of low flow rate, it is common to shift the turbo-compressor from a loaded operation to an unloaded operation, by fully closing inlet guide vanes provided in a suction side while a blow-off valve provided in a discharge side fully opened. Thus in this method, the characteristic of the compressor is shifted into an outside of the region where the surging occurs, in a suction flow rate with respect to discharge pressure thereof, by bringing the discharge pressure to be equal to the atmospheric pressure.

With such the method for avoiding from the surging as was mentioned above, it is possible to avoid the surging, however the power consumption of the compressor cannot be reduced so much. Then, a method for reducing the power consumption of the compressor is described, for example, in Japanese Patent Laying-Open No. Hei 4-136498 (1990). With the capacity control method described in this publication, a receiver tank is provided, so as to be used as a buffer for pressure fluctuation, and it is described that a setting value of pressure within the receiver tank is increased up to an upper limit allowable when a consumption gas amount comes down, thereby reducing a time-period of the unloaded operation. In this instance, when the pressure fluctuation within the receiver tank is frequent, the operation of the inlet guide vanes is lessened, thereby to prevent it from hunching.

Another example of the capacity control method of the compressor is described, for example, in Japanese Patent Laying-Open No. Hei 1-167498 (1989), adopting a low pressure control, as well as, an alternating control between a loaded operation and an unloaded operation. In this publication, the setting value of the discharge pressure is increased when consumption gas amount is lessened, in the same manner as was described in the Japanese Patent Laying-Open No. Hei 4-136498 (1990) mentioned above.

BRIEF SUMMARY OF THE INVENTION

An object is, according to the present invention, to provide a turbo-compressor controllable in capacity thereof, being improved in reliability. Other object is, according to the present invention, to provide a turbo-compressor being able to elongate a cycle time for maintenance. Further other object is, according to the present invention, to provide a turbo-compressor, in which inlet guide vanes can be made long in lifetime thereof. Then, at least any one of those objects can be achieved, according to the present invention.

For accomplishing the object(s) mentioned above, according to the present invention, there is provided a turbo-compressor, comprising: a compressor main body for compressing an operation fluid therein; an inlet guide vane apparatus being provided on a suction side of said compressor main body and having a plural number of guide vanes therein; a blow-off valve being provided on a discharge side of said compressor main body and being variable in opening thereof; a pressure detector means for detecting discharge pressure of said compressor; memory means for memorizing at least any one of a time-period and a number of times of operations of said inlet guide vane apparatus, when being operated by a guide vane opening being equal or less than a setting limit thereof; and a controller apparatus for controlling said blow-off valve and said guide vanes upon basis of values memorized in said memory means.

According to the present invention, preferably, there is provided the turbo-compressor, as described in the above, wherein said controller apparatus shifts the compressor main body into a unloaded operation condition where the opening of said guide vanes is fully closed, if pressure detected by said pressure sensor comes up to be equal or greater than a preset pressure in a case where the time-period or the number of times of operations of the compressor main body is equal or less than a predetermined value, while setting said guide vanes to be equal or less than a setting limit in the opening thereof, and also there is provided the turbo-compressor, preferably, as described in the above, wherein said controller apparatus controls said blow-off valve on the opening thereof while setting the opening of said guide vanes at a setting limit opening thereof, when pressure detected by said pressure sensor comes up to be equal or greater than a preset pressure at the time-period or the number of times of operations of the compressor main body comes up to be equal or less than a predetermined value, while setting said guide vanes to be equal or less than a limit in the opening thereof.

As other invention, for accomplishing the object(s) mentioned above, there is provided a capacity control method of a turbo-compressor with using an inlet guide vane apparatus and a blow-off valve, comprising the following steps of: opening said blow-off valve while bringing a guide vane opening of said guide vane apparatus into full-closed condition, when a time-period or a number of times of operations of the compressor is equal or less than a predetermined value, under condition of flow rate being equal or less than a surging limit flow rate, in an operation at a flow rate being equal or less than the surging limit of said compressor; and controlling said blow-off valve in opening thereof based upon a discharge pressure of said turbo-compressor, while setting opening of guide vanes of said inlet guide vane apparatus at a setting limit value, when the time-period or the number of times of operations exceeds a predetermined value in frequency thereof.

Preferably, there is provided the capacity control method of a turbo-compressor, as described in the above, wherein the guide vanes of said inlet guide vane apparatus are fully opened in the opening thereof, when the discharge pressure comes down to be equal or less than a second preset pressure, in an operation of controlling said blow-off valve while setting the guide vanes of said inlet guide vane apparatus at the setting limit value.

Further other invention, for accomplishing the object(s) mentioned above, there is also provided a capacity control method of a turbo-compressor, for driving by shifting among an unloaded operation to a loaded operation and a constant pressure control, comprising the following steps of: bringing the turbo-compressor into the unloaded operation, when a time-period or a number of times of operations of the compressor is equal or less than a predetermined value in frequency thereof, under condition of flow rate being equal or less than a surging limit flow rate, in an operation at flow rate being equal or less than the surging limit of said compressor; and bringing the turbo-compressor into the constant pressure operation, with using said blow-off valve, when the time-period or the number of times exceeds the predetermined value.

More preferably, the capacity control method of a turbo-compressor, as described in the above: wherein the turbo-compressor is changed into the unloaded operation when the discharge pressure comes down to be equal or less than a second setting pressure; the turbo-compressor is changed into the unloaded operation when suction flow rate of said turbo-compressor comes down to be equal or less than the predetermined value, under the constant pressure cooperation with using said blow-off valve; the setting value of frequency of the time-period or the number of times of operations is determined upon basis of a maintenance period of said turbo-compressor; or said setting value of frequency is obtained through dividing an operation time-period of the blow-off valve per a week by an operation time-period of the unloaded operation per one (1) time thereof.

DETAILED DESCRIPTION OF THE INVENTION

Figure 1:
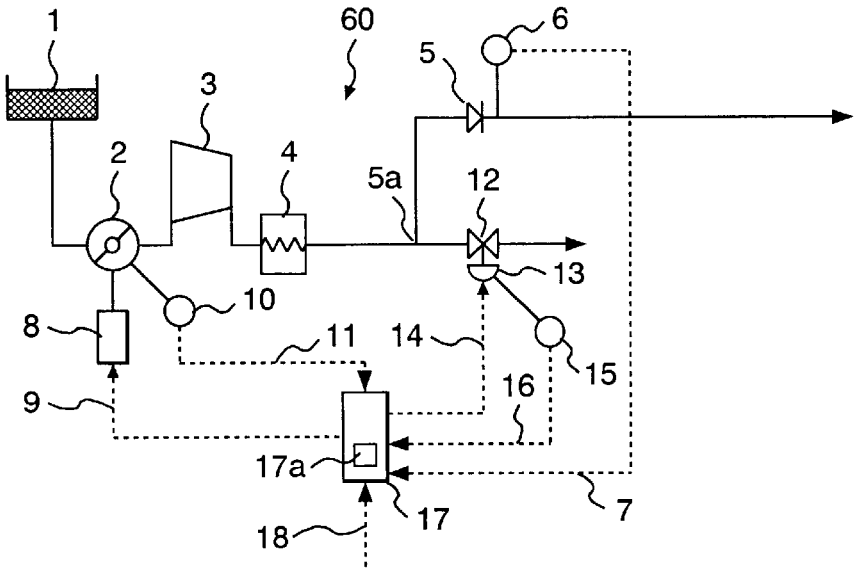
FIG. 1 is a system view of a turbo-compressor, according to an embodiment of the present invention.

Hereinafter, embodiments according to the present invention will be fully explained, by referring to the attached drawings. FIG. 1 is a system view of a turbo-compressor 60 of a single stage. An inlet guide vane apparatus 2, which comprises plural number of guide vanes being variable in a vane-opening angle thereof, is provided in an upstream side of a main body 3 of turbo-compressor for compressing an operation gas, and a suction filter 1 is provided in the further upstream side of this inlet guide vane apparatus 2.

A branch portion 5*a* is formed in a downstream side of the turbo-compressor main body 3, via a cooler 4 for cooling the operation gas. One of the branch portion 5*a* is connected to a check valve 5, and a pressure sensor 6 is attached, for detecting the discharge pressure of the turbo-compressor 60, in a downstream side of the check valve 5. A downstream side of the pressure sensor 6 is connected to a pipe for a customer. A blow-off valve 12 is connected to the other of the branch portion 5*a*, for releasing the air, as the operation gas, into the atmosphere. The blow-off valve 12 is made up with a control valve variable in the opening degree thereof, and a blow-off valve opening detector apparatus 15 is connected to this blow-off valve 12.

In the inlet guide vane apparatus 2, a guide vane opening detector 10 is provided for detecting an angle, at which the plural number of the inlet guide vanes (hereinafter, only "guide vanes") are attached, which are provided with this inlet guide vane apparatus 2. Further, the vane-opening angle of the guide vanes of the inlet guide vane apparatus 2 is set or determined by means of a guide vane controller 8. Also a controller apparatus 17 is provided, into which are inputted the discharge pressure of the turbo-compressor 60, being detected by the pressure sensor 6, the flow-off valve opening angle detected by the blow-off valve opening detector apparatus 15, and the detection signal of the guide vane opening, being detected by the guide vane opening detector 10. This controller apparatus 17 comprises a memory means, for memorizing a history of the opening angle of the inlet guide vanes and data of surging lines, which will be mentioned later.

Hereinafter, explanation will be made on operations of the turbo-compressor 60, being constructed as was mentioned in the above. The operation gas passing through the suction filter 1 is pressurized by means of the inlet guide vane apparatus 2, and then it is compressed within the turbo-compressor main body 3. After being cooled in the cooler 4, it passes through the check valve 5, so as to be sent out to a discharge side with desirable pressure. The pressure sensor 6, which is provided in the downstream side of the check valve 5, provides the discharge pressure in the form of an input, i.e., a pressure signal 7, to the controller apparatus 17.

The controller apparatus 17 sends a drive signal 9 to the guide vane controller 8, so that the discharge pressure Pbd of the turbo-compressor 60 lies on a target discharge pressure Pt, upon basis of the pressure signal 7 inputted and a target pressure signal 18 which is transferred from an upper controller means not shown in the figure. The guide driving apparatus 8 adjusts a guide vane-opening angle β of the inlet guide vane apparatus 2. The guide vane-opening angle β adjusted is fed back to the controller apparatus 17 in the form of a guide opening-angle signal 11.

Figure 2:
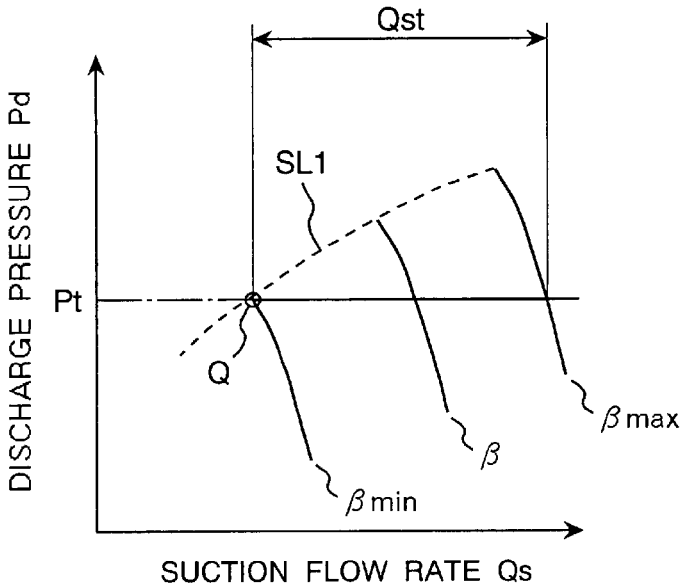
FIG. 2 is a graph for explaining a characteristic of the turbo-compressor, on a discharge pressure with respect to a suction flow rate.

When the controller apparatus 17 performs a capacity adjustment with using such the inlet guide vane apparatus 2, the turbo-compressor 60 shows such the characteristic curve, as shown in FIG. 2. In FIG. 2 indicating flow rate Qs on the horizontal axis while the discharge pressure Pd on the vertical axis, an operation range Qst of the compressor lies from the maximum suction flow rate of the compressor up to the minimum suction flow rate Qs1, obtained at an intersection point between the target discharge pressure Pt and a surging line SL1, which causes the unstable phenomenon, i.e., the surging, if it is less than that. Thus, the vane-opening angle of the guide vane of the inlet guide vane apparatus 2 is so changed, that the flow rate falls within such the range. The guide vane angle is βmax at the maximum suction flow rate, while βmin at the minimum suction flow rate.

By the way, an operation method is applied, exchanging among three kinds, i.e., the loaded operation, the unloaded operation and the constant pressure operation, in the turbo-compressor according to the present embodiment. The loaded operation is applied when the suction flow rate lies within the operation range Qst of the compressor shown in FIG. 2; thus, in the case where the consumption amount is relatively large of the operation gas at the consumer. Under the loaded operation, the opening of the guide vanes is adjusted, fitting to the gas consumption amount at the consumer. In more details, the controller apparatus 17 gives an instruction of the guide vane angle to the inlet guide vane driving apparatus 10, so that the discharge pressure of the compressor comes to the target pressure value Pt, which the discharge pressure sensor 6 detects.

Figure 3:
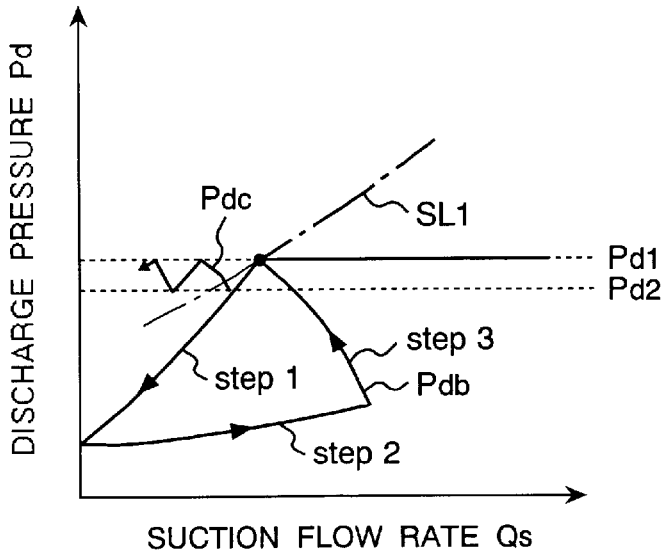
FIG. 3 is a graph for explaining change in the characteristic of the turbo-compressor.

When the gas consumption amount comes down, the discharge pressure detected by the discharge pressure sensor 6 exceeds the target pressure value Pt if the guide vane angle is narrowed down to the minimum angle βmin. In this case, since the surging occurs if the guide vane angle is further lowered, the controller apparatus 17 gives an instruction to the guide vane driving apparatus 8, thereby to shut down or close the inlet guide vanes at one (1) stroke, i.e., full-closed. Accompanying with this, an instruction is given to the blow-off valve driving apparatus 13, so that the blow-off valves 13 is also fully closed. This is the unloaded operation. In this unloaded operation, the suction flow rate of the compressor comes down to nearly equal zero (0), as shown in FIG. 3, and the discharge pressure is equal to the atmospheric pressure (see, a curve step 1). Accordingly, the surging can be avoided from, and the power of the compressor can be lowered down, greatly. Further, since the check valve 5 operates under this unloaded operation, it is possible to prevent the high-pressure gas from flowing in the reversed direction from the consumer side back to the compressor.

Since the supply of compressed gas is cut off or stopped to the discharge side, the pressure of discharge side is lowered gradually, depending upon the gas consumption amount, in the downstream side of the check valve 5. When the pressure at discharge side comes down to the predetermined value Pmin, the controller apparatus 17 gives an instruction to the guide vane driving apparatus 8, so that it makes the guide vanes open to the minimum opening angle βmin. Since the guide vanes are opened, the discharge pressure of the turbo-compressor 60 comes up a little bit, and also the suction flow rate increases (see, a curve step 2). After passing a predetermined time-period, the controller apparatus 17 sends an instruction signal 14 to the blow-off valve driving apparatus 13, so that it makes the blow-off valve 13 full-opened (see, a curve step 3). With this, it is shifted into the loaded operation.

Figure 4:
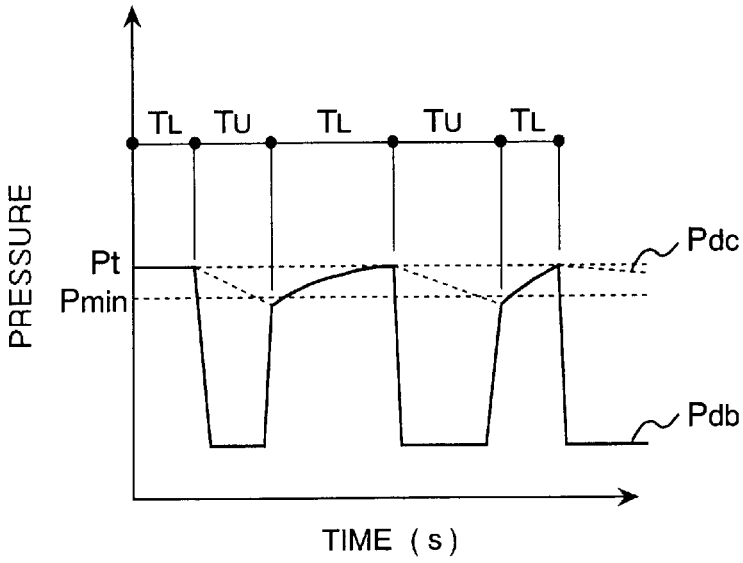
FIG. 4 is a graph for explaining a capacity control operation of the turbo-compressor.
Figure 5:
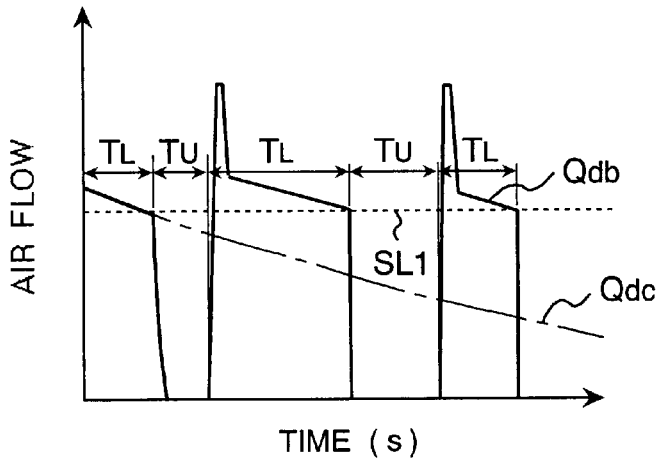
FIG. 5 is also a graph for explaining a capacity control operation of the turbo-compressor.

FIG. 4 shows changes in pressure when the loaded operation and the unloaded operation are repeated, while FIG. 5 shows changes in flow rate of the operation gas discharged from the compressor main body in that time. Under the loaded operation ($T_L$), the inlet guide vanes are fully opened, if the discharge pressure Pdc, which is detected by the pressure sensor 6 at the discharge side, exceeds the preset pressure Pt, and then the compressor is shifted into the unloaded operation ($T_U$). In this instance, the high-pressure gas at the consumer side will not blown off, due to an operation of the check valve. Also, since no high-pressure gas is supplied from the compressor main body 3, the discharge pressure Pdc, which is detected by the discharge pressure sensor 6, comes down in accordance with the gas consumption at the consumer side. When this pressure comes down to the minimum pressure Pmin preset, the blow-off valve 12 is fully closed, while the guide vanes are opened up to the guide vane angle on the surging limit. As a result of this, an amount Qdb of gas discharged from the compressor main body 3 changes along with a curve indicated by a solid line in FIG. 4. In this instance, the gas amount Qdb discharged from the compressor main body 3 comes down to nearly equal zero (0) under the unloaded operation ($T_U$). After being shifted into the loaded operation ($T_L$), the compressor continues the loaded operation until when the consumption gas comes down to the surge line (SL1) in the amount thereof. The consumption gas amount changes like a dashed (one-dot chain) line Qdc, when the loaded operation and the unloaded operation are repeated, alternatively.

By the way, when repeating between the loaded operation and the unloaded operation mentioned above, movable portions equipped within the inlet guide vane apparatus 2, in particular, the guide vanes, as well as, shaft bearings, a seal, for example, brings about being exhausted, fatigued, broken, or damaged, due to abrupt full-opening and return of the guide vanes. Then, according to the present invention, it is devised so that the frequency on shifts between the loaded operation and the unloaded operation is suppressed down to be equal or less than a predetermined frequency. Namely, for the purpose of counting up the number of exchanges between the unloaded operation and the loaded operation, the instructions are counted in the number thereof, which makes the blow-off valve 12 open and close, and are memorized in the memory means 17*a* provided in the controller apparatus 17. In the memory means 17*a*, for example, a number Nw of the operations for every week (per a week) or a number Nm of the operations for every month (per a month), in the name of the operation number.

A limit operation number Nmax is experimentally obtained in advance, for the inlet guide vanes. This is for the purpose of maintaining the turbo-compressor periodically, according to the present embodiment. It can be seen how many times the blow-off valve can be operated per a week, for the purpose of keeping the turbo-compressor free from generation of troubles therein, up to the timing for maintenance. From this, the limit number Nwmax can be obtained on the operations per a week, and that Nmmax on the operations per a month.

The operation number Nw of the blow-off valve 12, which is memorized in the memory means 17*a*, is compared with the limit operation number Nwmax (or Nmmax) mentioned above. In a case where the operation number Nw is equal or less than the limit operation number Nwmax ($Nw \leqq Nwmax$), a possibility is small or low that an accident will occur in the inlet guide vane apparatus 2 until the time of a coming maintenance of the turbo-compressor. Then, in the operation thereof, the turbo-compressor is operated while being shifted between the unloaded operation and the loaded operation.

On the contrary to this, if the operation number Nw exceeds the limit operation number Nwmax ($Nw > Nwmax$), the possibility is high that an accident will occur in the inlet guide vane apparatus 2 until the time of a coming maintenance of the turbo-compressor. Then, the operation of the turbo-compressor is shifted into the constant pressure operation where the guide vanes are not fully opened. Herein, the constant pressure operation means that, in which the blow-off valve 12 is controlled so that the detection pressure of the discharge pressure sensor 6 is kept at a constant, while reducing the angle of the guide vanes down to the limit angle where no surging occurs therein. With this constant pressure operation, since the abrupt operations can be avoided, such as the full-closing and/or returning operations of the inlet guide vanes, therefore it is possible to protect the guide vanes from deterioration thereof due to fatigue, as well as, the shaft seal portion from the damages thereof.

Figure 6:
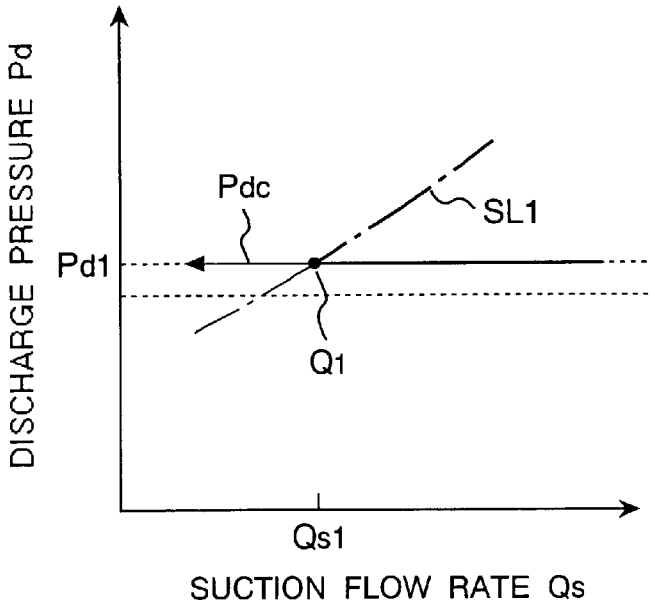
FIG. 6 is a graph for explaining a constant pressure control operation of the turbo-compressor.
Figure 7:
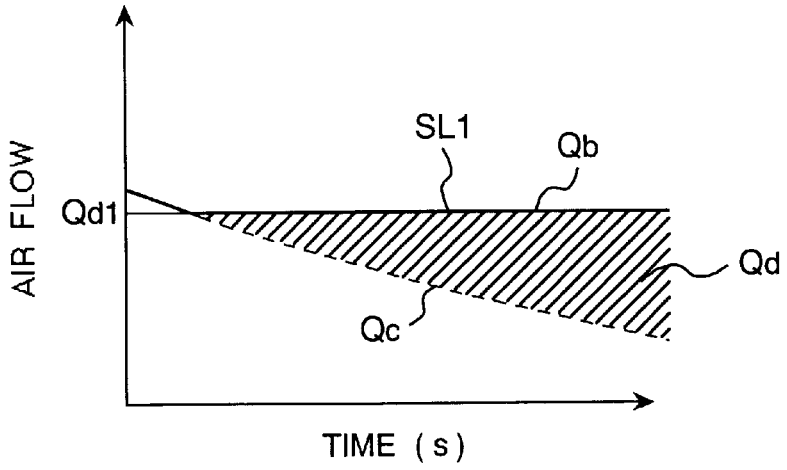
FIG. 7 is also a graph for explaining a constant pressure control operation of the turbo-compressor.

Under the constant pressure operation, a vane angle of the inlet guide vanes is maintained at the minimum opening angle βmin if the suction flow rate comes to be equal or less than a predetermined amount. With this, the compressor main body 3 can be operated under a stable condition, without generating the surging therein. Further, if the blow-off valve 12 is closed up under this condition, the flow rate is in excess, as well as, the discharge pressure rises up, therefore the opening of the blow-off valve is adjusted so that the pressure at the discharge side lies within a prescribed value. FIGS. 6 and 7 show those states.

Under the constant pressure operation, the compressor main body 3 continues the loaded operation under the condition where no surging occurs therein. Namely, an operation point $O_1$ of the compressor main body 3 comes to be at a surge limit point with the flow rate Qs1 and the pressure Pd1. A pressure Pdc at the customer side detected by the discharge pressure sensor 6 is maintained at Pd1, since the high-pressure gas compressed in the compressor main body 3 is released into the atmosphere in a large portion thereof. The suction flow comes down to be equal or less than the surge limit value Qs1 depending upon an amount of the air to be released. The gas amount released into the atmosphere comes to be the portion Qd indicated by hatched area in FIG. 7, if the gas consumption amount is not recovered at the customer side. Herein, the compressed gas amount Qb discharged from the compressor main body 3 is at the limit value Qd1, and is also of a consumption gas amount Qc.

If the consumption amount is recovered after the compressor is shifted into the constant pressure operation, the compressor is turned back to the operation shifting between the unloaded operation and the loaded operation. This state will be explained below. The operation time of the blow-off valve 12 is Tb for one week under the constant pressure operation, and it is memorized in the memory means 17*a* of the controller apparatus 17. This operation time Tb is divided by an averaged unloaded operation time $T_U$ (a constant), which is memorized in the memory means 17*a* in advance, i.e., the time-period being necessary for one (1) time of the unloaded operation, thereby obtaining the number of shifts between the unloaded operation and the loaded operation. The shifting time Nw is compared with the averaged shift number Nwmax for one week, which was obtained in advance. If the shift number Nw measured is equal or less than the averaged shift number Nwmax ($Nw \leqq Nwmax$), the compressor is turned back to the operation shifting between the unloaded operation and the loaded operation, again. With this, the consumption power can be reduced. Also, the guide vanes can be suppressed in the operation number thereof, within the allowable limit, thereby preventing the inlet guide vane apparatus 2 from the deterioration due to the fatigue and wear-out thereof.

Figure 8:
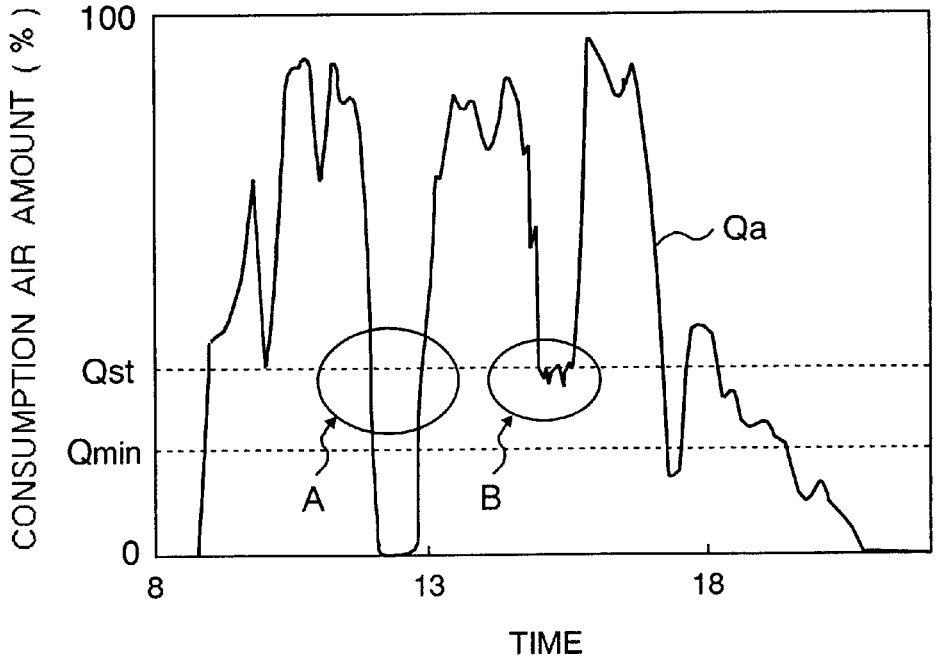
FIG. 8 is a graph for showing an example of change in an amount of compression gas consumption within a day in a factory.
Figure 9:
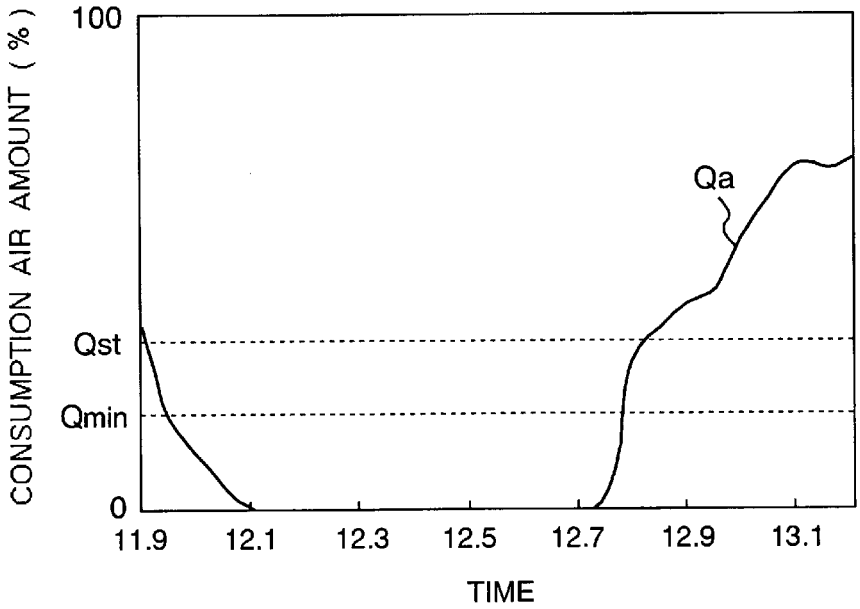
FIG. 9 is a graph for showing an example of change in an amount of compression gas consumption within a specific time-period in a factory.
Figure 10:
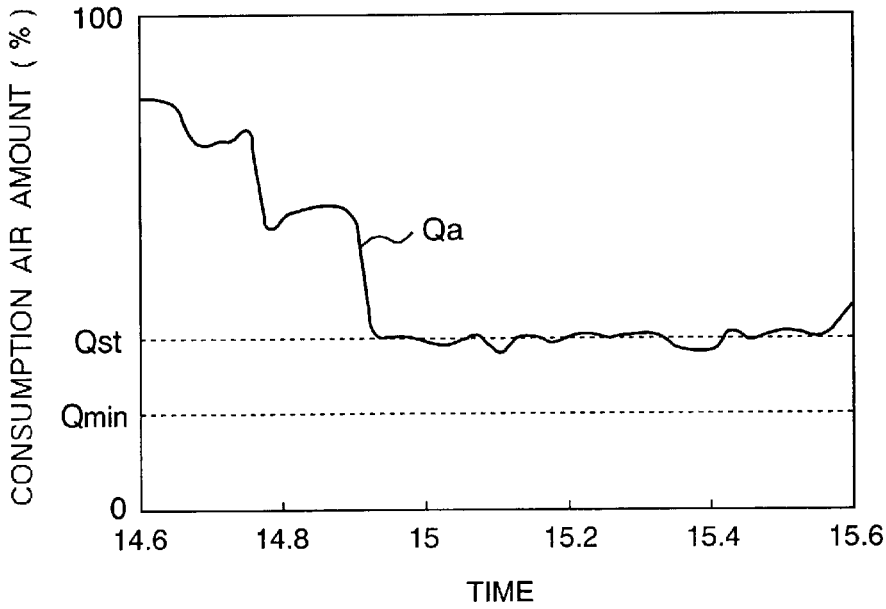
FIG. 10 is also a graph for showing an example of change in an amount of compression gas consumption within a specific time-period in a factory.

Explanation will be given on another embodiment according to the present invention, by referring FIGS. 8 through 10. In the present embodiment, the condition of gas consumption at the customer side was grasped in advance, for achieving forecasting control of the turbo-compressor. FIG. 8 shows an example of change in consumption air amount Qa within a certain factory. In the time-period for a lunch, the gas consumption Qa comes down to zero (0) or nearly equal thereto (a condition A). Also, around three (3) PM, i.e., a break time in the afternoon, the gas consumption amount is only that amount, which is necessary for keeping machines operable, i.e., under the waiting condition thereof. For this reason, for the capacity of the compressor main body, the gas consumption amount lies in the vicinity of the surging limit (a condition B). The gas consumption amount Qa comes down, again, in the vicinity of five (5) PM when working is finished, in general, and thereafter it is reduced gradually until the midnight when the operating of the factory is stopped.

If the tendency is already known on the gas consumption amount Qa, the consumption power can be lowered much more, comparing to the embodiment mentioned above. It is same to the embodiment mentioned above, that the compressor is shifted to operate under the unloaded operation when the gas consumption amount Qa comes down to be equal or less than the surging limit. It is also same to the embodiment mentioned above, that it is shifted into the constant pressure operation, when the shift number Nw between the loaded operation and the unloaded operation exceeds the limit shift number Nwmax1 which was obtained in advance (Nw>Nwmax1). The limit shift number Nwmax1 is so determined, that it is smaller than the limit shift time (Nwmax>Nwmax1), in the embodiment mentioned above.

By the way, it is already known that the consumption air amount Qa cannot not be recovered for a moment (see FIG. 9), when the compressor is turned into the condition A shown in FIG. 8, under the loaded operation. Then, the compressor is shifted, not the constant pressure operation, but into the unloaded operation, since there is no chance that open-close operation will occur abruptly upon the guide vanes if it exceeds the limit Nwmax2 in the shift number thereof. Operation of the turbo-compressor in this manner brings about a necessity of fully closing the guide vanes and turning the guide vane back to the preset angle βmin of the surging limit when the gas consumption recovers thereafter, however since it is only 1 or 2 times in the number thereof, therefore it only gives a small damage on the inlet guide vanes. Also, there is no change that the compression gas compressed within the compressor main body is released into the atmosphere; therefore the consumption power of the turbo-compressor can be reduced.

On the contrary to this, if the compressor is turned to operate under the condition B shown in FIG. 8 (see FIG. 10), it can be expected to operate in the vicinity of the surging limit flow rate Qs1, therefore it is shifted into the constant pressure operation, avoiding frequent generation of the unloaded operation, which accompanies with the abrupt rotation of the guide vanes. Namely, the angle of the guide vanes is set at the angle βmin of the surging limit while the blow-off valve 12 is controlled to maintain constant delivery pressure. The compressor is shifted from the constant pressure operation into the unloaded operation only when the gas consumption amount Qa is further comes down to be equal or less than the amount Qmin which is determined in advance. This condition corresponds to the condition A shown in FIG. 8, for example.

According to the present method, since the compressor is operated under the constant pressure operation when the gas consumption amount Qa changes in the vicinity of the surging limit flow rate Qs1, it is possible to protect the guide vane apparatus, but without necessary of bringing the guide vanes back to the full-closed condition, nor turning the guide vanes back to the angle βmin at the time of the surging limit, thereafter. Further, this brings about the operation in the vicinity of the surging limit flow rate Qs1, therefore the compression gas amount ΔQ to be released is relatively small in the amount thereof, i.e., the difference between the surging limit flow rate and the consumption gas flow rate ($\Delta Q = Qs1 - Qa$), therefore the consumption power can be lowered in the turbo-compressor.

According to the present embodiment, it is possible to further reduce the consumption power, comparing to the embodiment(s) mentioned above. Also, controlling the minimum flow rate Qmin under the constant pressure operation, depending upon the installation condition of the turbo-compressor by means of the controller apparatus, it enables to achieve an easy control of the operation number of the guide vanes; i.e., the operation number of the inlet guide vanes can be made less than the limit operation number, easily. Further, the single-stage compressor is shown in each of the embodiments mentioned above, however it is also practicable to build up the turbo-compressor with compressors of a plural number of stages, in the similar manner.

According to the present invention, since the turbo-compressor is operated by shifting between the loaded operation and the unloaded operation, therefore it is possible to achieve an improvement on reliability, as well as, the reduction of power in the turbo-compressor, at the same time.

What is claimed is:

1. A turbo-compressor, comprising:

a compressor main body for compressing an operation fluid therein;

an inlet guide vane apparatus being provided on a suction side of said compressor main body and having a plural number of guide vanes therein;

a blow-off valve being provided on a discharge side of said compressor main body and being variable in opening thereof;

a pressure detector means for detecting discharge pressure of said compressor;

memory means for memorizing at least any one of a time-period and a number of times of operations of said inlet guide vane apparatus, when being operated by a guide vane opening being equal or less than a setting limit thereof; and a controller apparatus for controlling said blow-off valve and said guide vanes upon basis of values memorized in said memory means.

2. A turbo-compressor, as described in the claim 1, wherein said controller apparatus shifts the compressor main body into an unloaded operation condition where the opening of said guide vanes is fully closed, if pressure detected by said pressure sensor comes up to be equal or greater than a preset pressure in a case where the time-period or the number of times of operations of the compressor main body is equal or less than a predetermined value, while setting said guide vanes to be equal or less than a setting limit in the opening thereof.

3. A turbo-compressor, as described in the claim 1, wherein said controller apparatus controls said blow-off valve on the opening thereof while setting the opening of said guide vanes at a setting limit opening thereof, when pressure detected by said pressure sensor comes up to be equal or greater than a preset pressure at the time-period or the number of times of operations of the compressor main body comes up to be equal or less than a predetermined value, while setting said guide vanes to be equal or less than a limit in the opening thereof.

4. A capacity control method of a turbo-compressor with using an inlet guide vane apparatus and a blow-off valve, comprising the following steps of:

opening said blow-off valve while bringing a guide vane opening of said guide vane apparatus into full-closed condition, when a time-period or a number of times of operations of the compressor is equal or less than a predetermined value, under condition of flow rate being equal or less than a surging limit flow rate, in an operation at a flow rate being equal or less than the surging limit of said compressor; and controlling said blow-off valve in opening thereof closed upon a discharge pressure of said turbo-compressor, while setting opening of guide vanes of said inlet guide vane apparatus at a setting limit value, when the time-period or the number of times of operations exceeds a predetermined value in frequency thereof.

5. A capacity control method of a turbo-compressor, as described in the claim 4, wherein the guide vanes of said inlet guide vane apparatus are fully opened in the opening thereof, when the discharge pressure comes down to be equal or less than a second preset pressure, in an operation of controlling said blow-off valve while setting the guide vanes of said inlet guide vane apparatus at the setting limit value.

6. A capacity control method of a turbo-compressor, for driving by shifting among an unloaded operation, a loaded operation and a constant pressure control, comprising the following steps of:

bringing the turbo-compressor into the unloaded operation, when a time-period or a number of times of operations of the compressor is equal or less than a predetermined value in frequency thereof, under condition of flow rate being equal or less than a surging limit flow rate, in an operation at flow rate being equal or less than the surging limit of said compressor; and bringing the turbo-compressor into the constant pressure operation, with using said blow-off valve, when the time-period or the number of times exceeds the predetermined value.

7. A capacity control method of a turbo-compressor, as described in the claim 6, wherein the turbo-compressor is changed into the unloaded operation when the discharge pressure comes down to be equal or less than a second setting pressure.

8. A capacity control method of a turbo-compressor, as described in the claim 6, wherein the turbo-compressor is changed into the unloaded operation when suction flow rate of said turbo-compressor comes down to be equal or less than the predetermined value, under the constant pressure cooperation with using said blow-off valve.

9. A capacity control method of a turbo-compressor, as described in the claim 6, wherein the setting value of frequency of the time-period or the number of times of operations is determined upon basis of a maintenance period of said turbo-compressor.

10. A capacity control method of a turbo-compressor, as described in the claim 6, wherein said setting value of frequency is obtained through dividing an operation time-period of the blow-off valve per a week by an operation time-period of the unloaded operation per one (1) time thereof.

* * * * *